US010801270B2

(12) United States Patent
Plano et al.

(10) Patent No.: US 10,801,270 B2
(45) Date of Patent: Oct. 13, 2020

(54) JACK-UP RIG FOR PERFORMING MULTIPLE INDEPENDENT OPERATIONS SIMULTANEOUSLY

(71) Applicant: National Oilwell Varco Norway AS, Kristiansand (NO)

(72) Inventors: Marco Plano, Kristiansand (NO); Roar Berge, Kristiansand (NO)

(73) Assignee: National Oilwell Varco Norway AS (NO)

( * ) Notice: Subject to any disclaimer, the term of this patent is extended or adjusted under 35 U.S.C. 154(b) by 0 days.

(21) Appl. No.: 16/309,875

(22) PCT Filed: Jun. 14, 2017

(86) PCT No.: PCT/NO2017/050158
§ 371 (c)(1),
(2) Date: Dec. 13, 2018

(87) PCT Pub. No.: WO2017/222389
PCT Pub. Date: Dec. 28, 2017

(65) Prior Publication Data

US 2019/0136637 A1 May 9, 2019

(30) Foreign Application Priority Data

Jun. 24, 2016 (EP) ..... 16176113

(51) Int. Cl.

| | |
|---|---|
| ***E21B 15/02*** | (2006.01) |
| ***E02B 17/02*** | (2006.01) |
| ***E21B 15/00*** | (2006.01) |

(52) U.S. Cl.
CPC ..... *E21B 15/003* (2013.01); *E02B 17/021* (2013.01); *E21B 15/02* (2013.01); *E02B 17/02* (2013.01)

(58) Field of Classification Search
CPC ..... E21B 15/003; E21B 15/02; E02B 17/021
See application file for complete search history.

(56) References Cited

U.S. PATENT DOCUMENTS 3,474,629 A * 10/1969 Woodson ..... E21B 15/003 405/201
3,477,235 A 11/1969 Branham et al.
(Continued)

FOREIGN PATENT DOCUMENTS

WO WO2004035985 4/2004
WO WO2014120085 8/2014
(Continued)

OTHER PUBLICATIONS

Written Opinion for PCT/NO2017/050158 dated Aug. 23, 2017 (3 pages).

(Continued)

*Primary Examiner* — Matthew R Buck
(74) *Attorney, Agent, or Firm* — Conley Rose, P.C.

(57) ABSTRACT

Disclosed is a jack-up rig that includes a cantilever platform mounted on a buoyant hull. At least two drilling assemblies are provided on the cantilever platform, each of the drilling assemblies being movable relative to the cantilever platform and being moveable independently from the other drilling assembly or assemblies. Each of the drilling assemblies is also movable within a plane that is parallel to the cantilever platform in both X-direction as well as Y-direction which is orthogonal to the X-direction.

4 Claims, 7 Drawing Sheets

(56) References Cited

U.S. PATENT DOCUMENTS

| | | | | |
|---|---|---|---|---|
| 6,171,027 | B1 * | 1/2001 | Blankestijin | E02B 17/021 405/201 |
| 6,491,477 | B2 * | 12/2002 | Bennett, Jr. | E21B 15/003 114/265 |
| 9,260,920 | B2 * | 2/2016 | Seng | E21B 15/003 |
| 10,337,258 | B2 * | 7/2019 | Dowdy | E02B 17/021 |
| 2012/0018166 | A1 * | 1/2012 | Croatto | E21B 19/006 166/355 |
| 2014/0326510 | A1 | 11/2014 | Wessell | |
| 2017/0321490 | A1 * | 11/2017 | Haavind | E21B 15/02 |

FOREIGN PATENT DOCUMENTS

| | | |
|---|---|---|
| WO | WO2016076730 | 5/2016 |
| WO | WO2016175657 | 11/2016 |
| WO | 2017/095676 A1 | 6/2017 |
| WO | WO2017102109 | 6/2017 |

OTHER PUBLICATIONS

International Search Report for PCT/NO2017/050158 dated Aug. 23, 2017 (5 pages).

* cited by examiner

PRIOR ART

JACK-UP RIG FOR PERFORMING MULTIPLE INDEPENDENT OPERATIONS SIMULTANEOUSLY

CROSS REFERENCE TO RELATED APPLICATIONS

This application is a 35 U.S.C. § 371 national stage application of PCT/NO2017/050158 filed Jun. 14, 2017 and entitled "Jack-Up Rig for Performing Multiple Independent Operations Simultaneously", which claims priority to European Patent Application No. 16176113.5 filed Jun. 24, 2016, each of which is incorporated herein by reference in their entirety for all purposes.

STATEMENT REGARDING FEDERALLY SPONSORED RESEARCH OR DEVELOPMENT

Not applicable.

FIELD OF THE INVENTION

The invention relates to a jack-up rig comprising a cantilever platform mounted on a buoyant hull, wherein said jack-up rig includes two or more drilling assemblies mounted thereon.

BACKGROUND

A jack-up rig is a floating drilling unit that can jack up on its legs and have the same stability as a fixed platform. In order to start a drilling operation, the jack-up rig will be towed to a target location, it will lower its legs on the sea floor and jack up above sea level. Once the jack-up rig is ready, a so-called cantilever platform will extend over a pre-made wellhead pattern to start drilling one well at the time. Such pre-made wellhead pattern may be located on another platform or placed directly on the seafloor. A cantilever platform is a platform that supports the drilling tower (derrick). The cantilever platform can move both in/out as well as right/left.

A lot of development has been carried out in order to reduce operation time.

WO2010/019858A1 discloses a multi-function multi-hole rig which, in certain aspects, includes multiple machines for accomplishing rig functions, e.g. drilling machine(s), tripping machine(s), casing machine(s), and/or cementing machine(s), for producing multiple usable wellbores one after the other.

U.S. Pat. No. 4,819,730 discloses a floating drilling platform having dual workstations for performing deep sea drilling and/or hydrocarbon production operations. The structure of the platform is designed to accommodate replaceable modules, which facilitate the installation and removal of either a drilling derrick or production equipment. Thus, during the drilling phase of a reservoir's development, the platform may be outfitted with dual drilling derricks while at later times the platform may be outfitted with a drilling derrick and a full production facility. Various expedients are available to permit the equipment of one workstation to be used in conjunction with the equipment of one other. Simultaneous management of dual conductors is enabled by a dual riser management system, which models in realtime riser behaviour under varying environmental and other operational conditions. The dual riser management system includes a riser analysis subsystem, a mooring analysis subsystem and a vessel stability analysis subsystem.

U.S. Pat. No. 6,056,071A discloses a multi-activity drillship having a single derrick and multiple tubular activity stations within the derrick wherein primary drilling activity may be conducted from the derrick and simultaneously auxiliary drilling activity may be conducted from the same derrick to reduce the length of the primary drilling activity critical path.

WO2012/053982A1 discloses an ice-worthy jack-up rig that may extend the drilling season in shallow water in off shore Arctic or ice prone locations. This rig works like a conventional jack-up rig while in open water with the hull jacked up out of the water. However, in the event of ice conditions, the hull is lowered into the water into an ice defensive configuration. The hull is specifically shaped with a lower portion that is an ice-bending surface to bend and break up ice that comes in contact with the hull while in the ice defensive configuration. Furthermore, the ice worthy jack-up rig that comprises at least two derricks, each being provided on their own cantilever, so as to double the exploration efficiency and lower the relating costs.

CN2012/65362Y discloses a dual-operation pyramid derrick used for placing an overhead crane, handing a suspension system, placing a drill rod, and handling underground accidents during the drilling process. The dual-operation pyramid derrick can be used on land, and can be used on an ocean platform. The derrick is of a double-top tower type structure, a derrick body enables two pyramid derricks to be connected into a whole and comprises an upper section and a lower section, and the cross section of the derrick body is of a rectangular demountable closed type steel structure such that its bearing capacity is large, and the integral stability is good. The entire derrick body is connected into a whole by six upright columns and a plurality of sidewise web members through high-strength bolts. The main body of the derrick is made of broad flange beams, three sides of the derrick are in a conical shape, and one side is vertical to the height of 31 m, and then is inclined towards the overhead crane. The structure improves the stressed state of the derrick, reduces the structural weight and saves the rig cost. Two sets of well drilling systems of main lifting systems and auxiliary lifting systems can be installed on the derrick; and the web members of the derrick adopt diamond-shaped lattice masts with small wind resistance, therefore, the load under the wind action is reduced.

Even if the above-mentioned development have contributed to reduced operation time, there is still a need for further reduction of operation time and thereby operation costs, in particular for jack-up rigs.

SUMMARY OF THE DISCLOSURE

The present disclosure is directed to remedying or reducing at least one of the drawbacks of the prior art, or at least provide a useful alternative to prior art.

In a first aspect this disclosure relates to a jack-up rig comprising a cantilever platform mounted on a buoyant hull. At least two drilling assemblies are provided on the cantilever platform, wherein each of the drilling assemblies is movable relative to the cantilever platform and independently from the other drilling assembly or assemblies, respectively, wherein each of the drilling assemblies is movable in both X-direction as well as Y-direction orthogonal to the X-direction.

The effects of the jack-up rig in accordance with this disclosure are as follows. Two, preferably compact, drilling assemblies (i.e. derrick assemblies) are provided on a single cantilever platform. Moreover, these drilling assemblies are independently movable (within a plane parallel to the cantilever platform in both X-direction as well as Y-direction orthogonal to the X-direction) from each other. First of all, this leads to a cost-effective space saving solution for the cantilever, but also results in more flexible multiple-derrick (or drilling unit) jack-up rig. Furthermore, the respective drilling assemblies within the multiple derrick jack-up rig may be placed more quickly and more flexibly on the respective well targets, instead of having to modify two cantilever jack-up platforms as in one of the discussed prior art solutions. Furthermore, when two (movable) cantilevers are used, as in the prior art, this will always lead to a space loss, compared to the single (large) cantilever in accordance with this disclosure.

In order to facilitate understanding of this disclosure one or more expressions are further defined hereinafter.

At places in this specification where the wording "drilling assembly" is used, this refers to an assembly of a derrick or other drilling unit for carrying out well operations like drilling, well completion, well intervention or production, a drilling support structure. At places in this specification where the wording "movable drilling assembly" is used, this also includes a skid system or something comparable.

In an embodiment of the jack-up rig in accordance with this disclosure, the drilling assemblies are provided on a skid system. Skid systems are as such proven technology. Therefore, such systems constitute a convenient solution for making the drilling assemblies movable relative to the cantilever platform and relative to each other. The skid systems are to be placed at an opening in the cantilever platform for allowing drilling operations to be performed by the respective drilling assembly.

In another embodiment of the jack-up rig in accordance with this disclosure, the skid system comprising:

X-direction rails provided on the cantilever platform;

at least two Y-direction support frames slideably mounted on the X-direction rails; Y-direction rails provided on each of the Y-direction support frames, and one respective drilling support structure on respective Y-direction rails of each one of the Y-direction support frames. This embodiment conveniently provides for a compact skid system for moving two (or more) drilling assemblies instead of one, i.e. two (or more) individual skid systems have been integrated into one, wherein the X-direction rails are effectively shared by said Y-direction support frames. Such skid system could also be referred to as a "dual-skid" or "twin-skid" and forms a very compact solution in terms of areal consumption on the cantilever platform.

Another embodiment of the jack-up rig in accordance with this disclosure further comprises respective skid-manipulators mounted for skidding respective movable parts along said rails. The skid-manipulators maybe conveniently used in combination with said rails.

In an embodiment of the jack-up rig in accordance with this disclosure, the skid system comprising:

XY-rails provided on the cantilever platform, wherein the XY-rails are arranged to form an array of rails;

at least two XY-support frames mounted on the XY-rails such that the XY-support frames can slide both directions in accordance with the respective directions of the XY-rails, and one respective drilling support structure on each one of the XY-support frames. This, second, embodiment also provides for a compact skid system for moving two (or more) drilling assemblies instead of one, i.e. two (or more) individual skid systems have been integrated into one, wherein the XY-rails are effectively shared by said XY-support frames. A main difference with the earlier mentioned first embodiment is, however, that the second embodiment is more flexible, in that the respective drilling assemblies can exchange places completely, which is clearly not possible in the first embodiment. Expressed differently, each drilling assembly may move along the rails to any place that is free. In the detailed description below, an example is given with four sectors, but any number of sectors is possible, increasing the flexibility to an even higher level. In one variant of this embodiment, on respective crossings and corners, the rails are provided with interruptions to facilitate a change of skidding directions at the crossings. This is one way of providing XY-skidding, but there are also other ways.

In another embodiment of the jack-up rig in accordance with this disclosure, at least one further skid system is provided between each respective drilling support structure and respective XY-support frame for enabling at least one extra translation degree-of-freedom. This embodiment solves the potential problem of "blind spots" in the respective well pattern, i.e. well targets, which cannot be reached by the respective drilling assemblies, because they are effectively standing in each other's way. In the detailed description below, an example is given with only one extra pair of X-direction rails per XY-support frame, but they may be easily extended with an extra pair of Y-direction rails (on a respective frame).

An embodiment of the jack-up rig in accordance with this disclosure further comprises respective skid-manipulators mounted for skidding respective parts along the rails. The skid-manipulators maybe conveniently used in combination with said rails. Preferably, the skid-manipulators are such that they can be completely released, for instance by lifting up, from said rails. This is further explained in the detailed description below.

In another embodiment of the jack-up rig in accordance with this disclosure, each drilling assembly comprises a drilling unit placed on the drilling support structure. In this respect, this embodiment complies with the conventional way of placing a drilling assembly on a cantilever platform to facilitate placement of all other necessary equipment to carry out said operations.

BRIEF INTRODUCTION OF THE DRAWINGS

The detailed description below provides examples of embodiments illustrated in the accompanying drawings, wherein.

Figure 8:
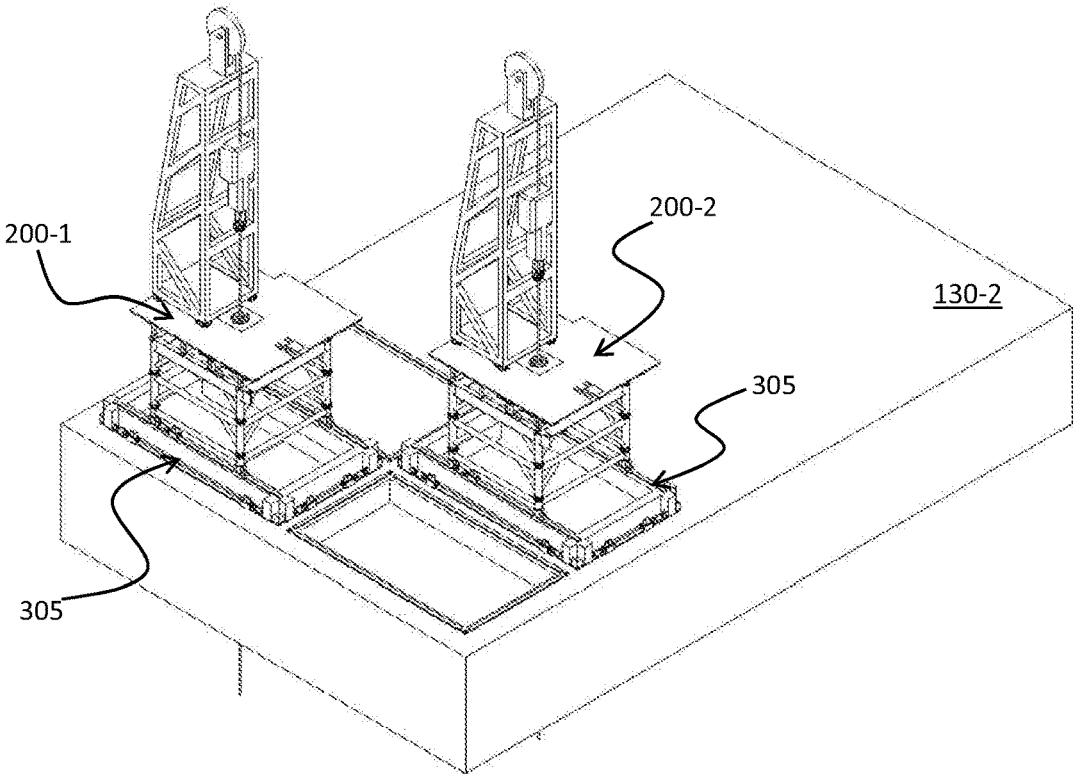
FIG. 8 shows a second embodiment of a movable dual derrick assembly in accordance with this disclosure.
Figure 9A:
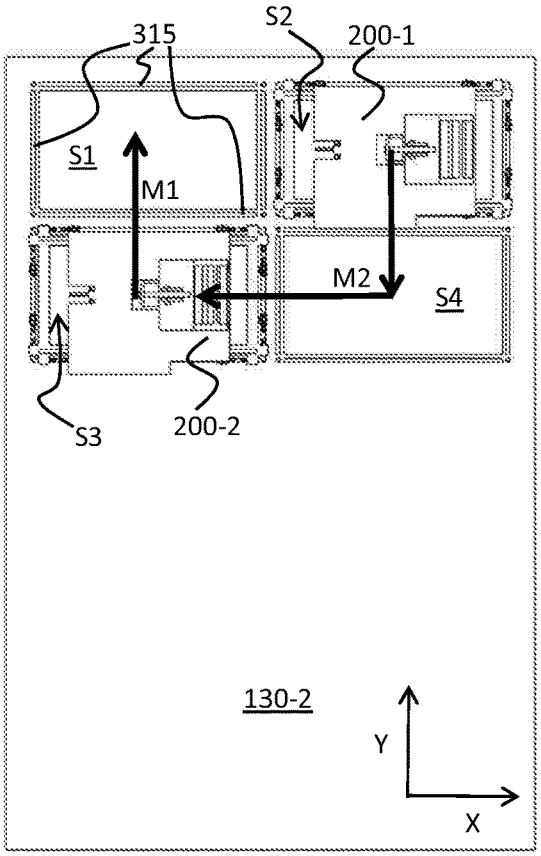
Figure 9B:
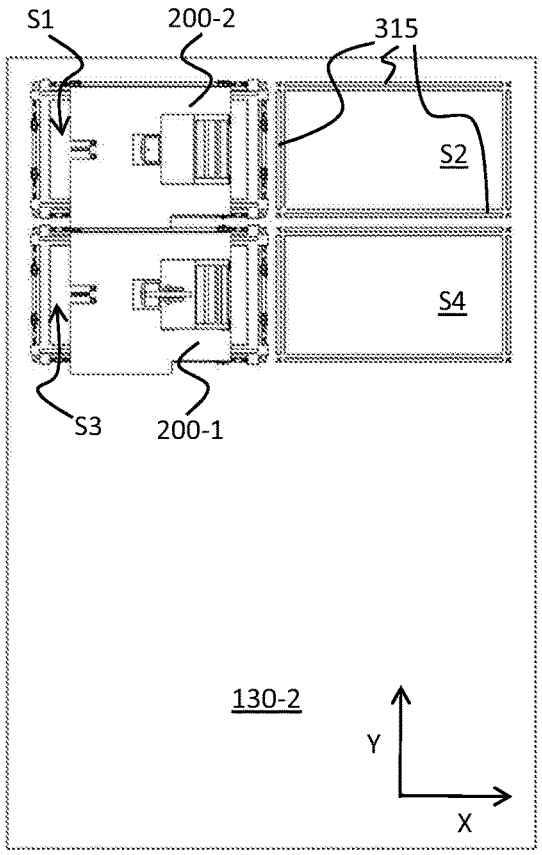
Figure 10:
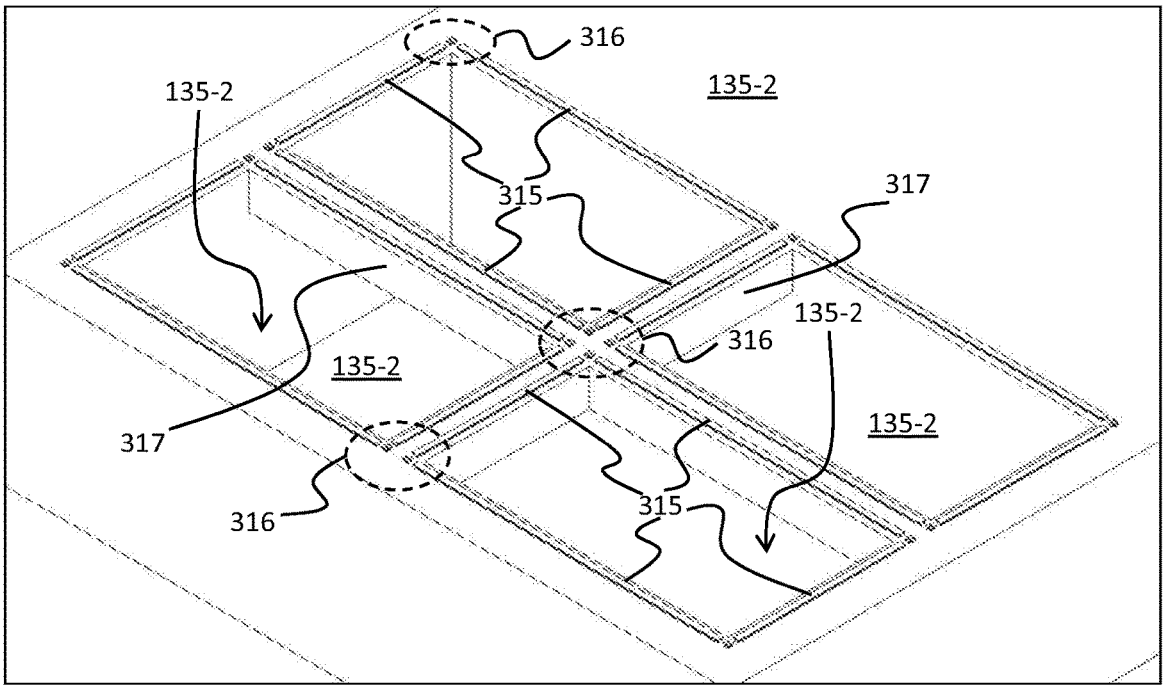
Figure 11:
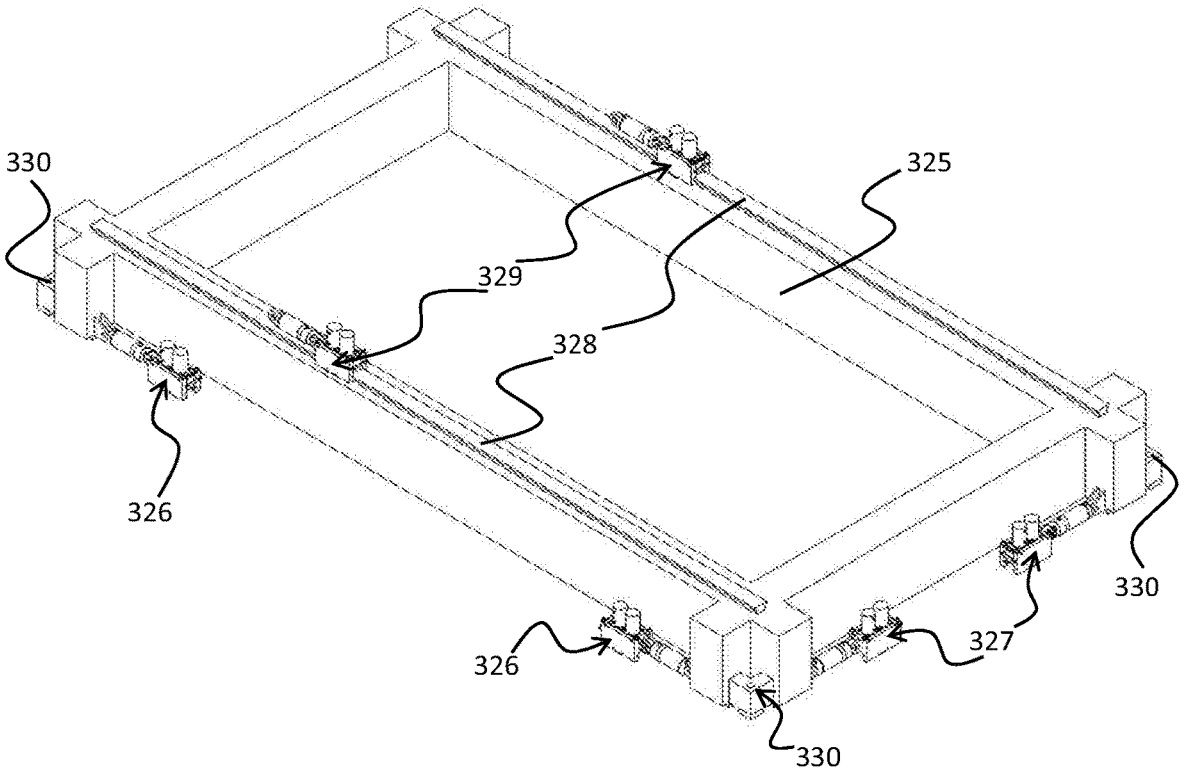
Figure 12:
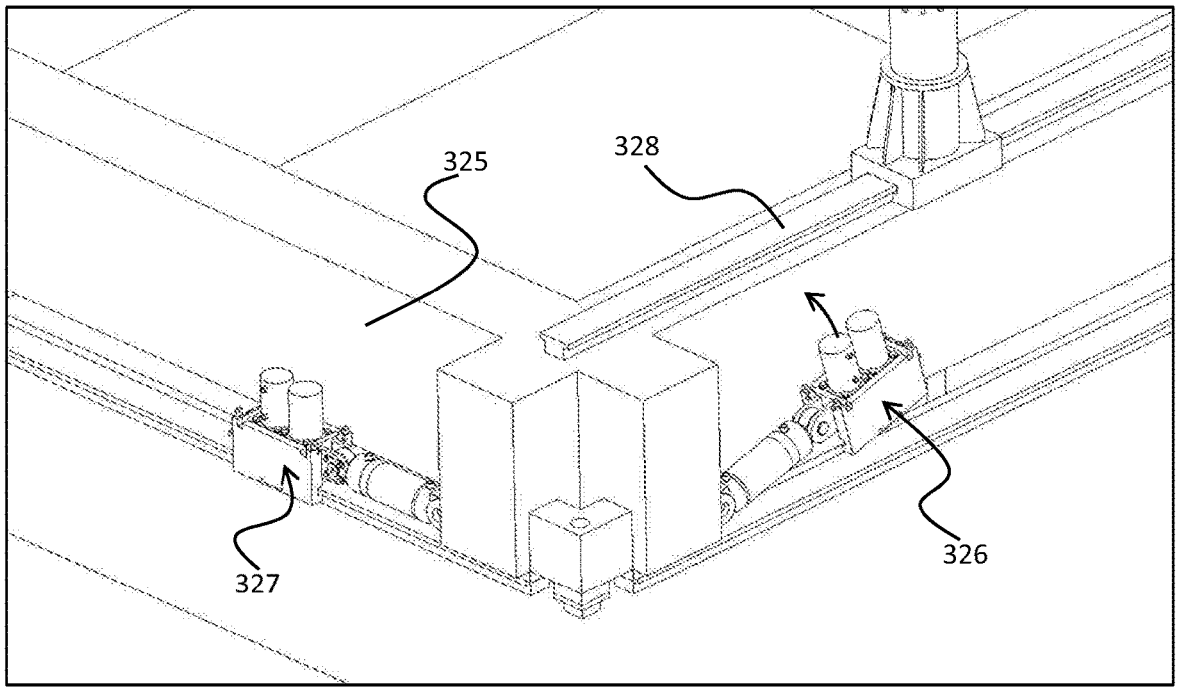
Figure 13:
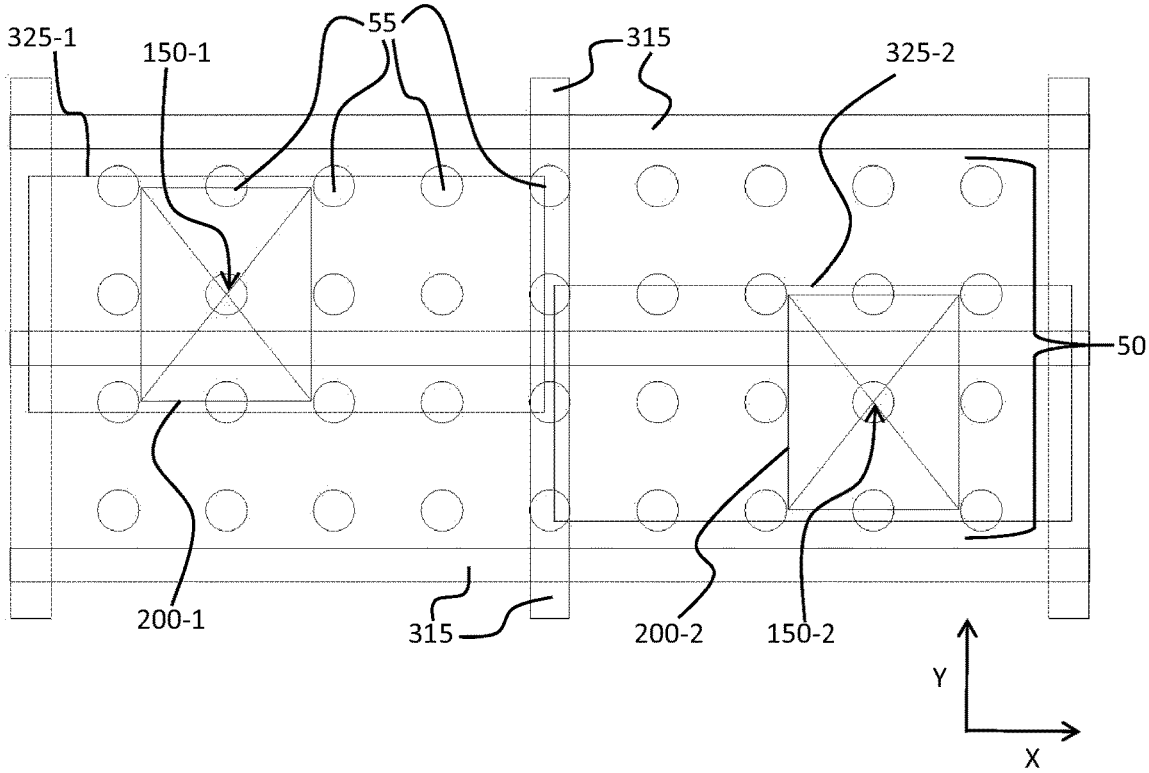

FIGS. 9*a*-9*b* show a top view of the embodiment of FIG. 8 each with the respective derricks in different positions;

FIG. 10 shows part of the skidding system used in the embodiment of FIG. 8;

FIG. 11 shows another part of the skidding system used in the embodiment of FIG. 8;

FIG. 12 shows an enlarged view of part of the skidding system illustrated in FIG. 11, when the derrick support structure is provided on top of it, and FIG. 13 shows a schematic plan view of the embodiment of FIG. 8 when provided above a well pattern.

DETAILED DESCRIPTION OF THE DISCLOSED EXEMPLARY EMBODIMENTS

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In all figures the drilling assembly is exemplified with a derrick assembly. However, this disclosure is not limited to the use of derricks in the drilling operations, but includes any kind of drilling unit for carrying out well operations like drilling, well completion, well intervention or production.

Figure 1:
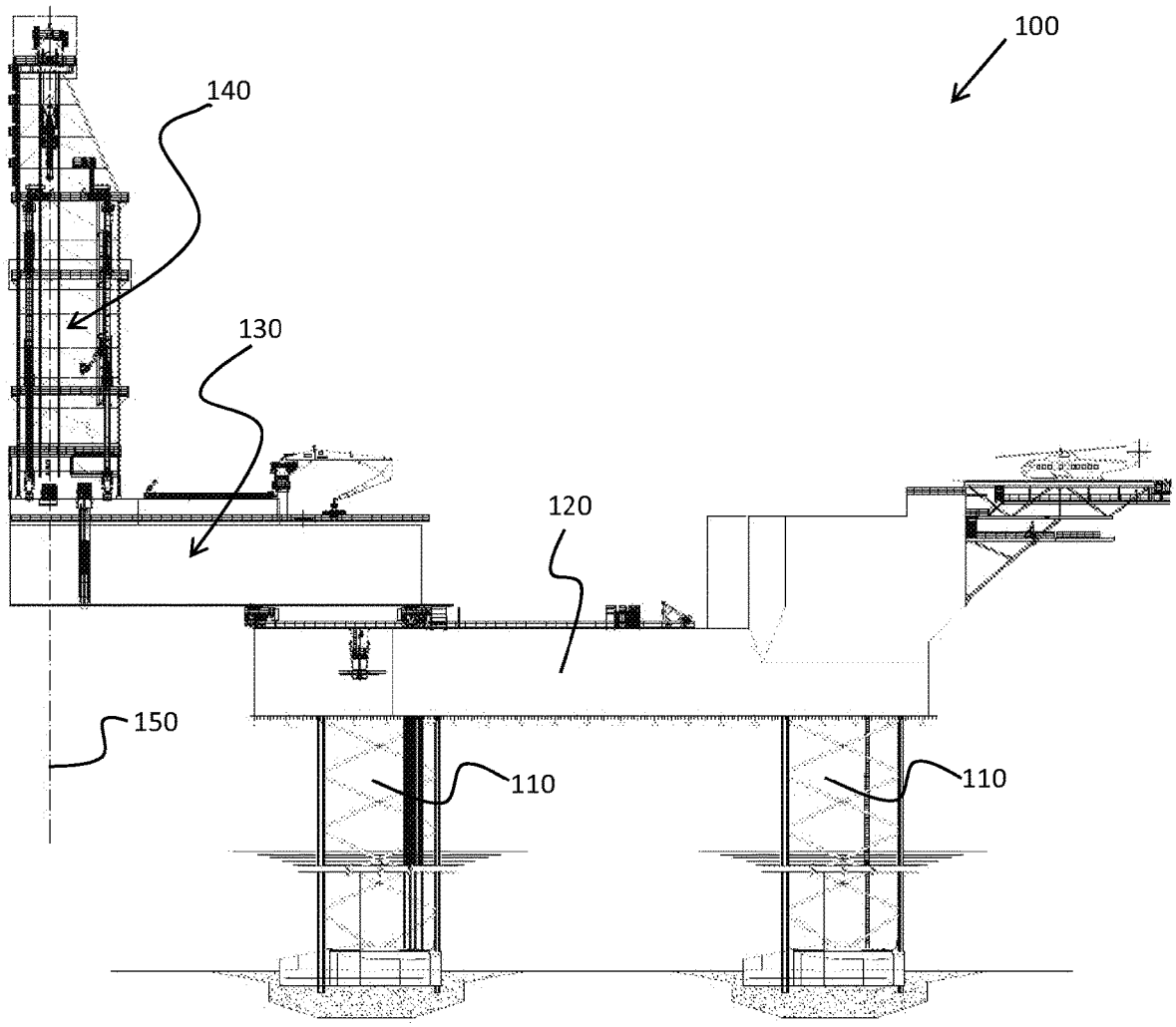
FIG. 1 shows a jack-up rig with a single derrick as known from the prior art.

FIG. 1 shows a jack-up rig 100 with a single derrick 140 as known from the prior art. The jack-up rig 100 comprises a buoyant hull 120 having at least three movable legs 110 mounted thereto. On the buoyant hull 120 there is provided a cantilever platform 130 having a derrick 140 placed at an end thereof, as shown. The derrick 140 has an operational centerline 150, which is to be aligned, by movement of the jack-up rig 100 and/or translation of the cantilever platform 130, with the respective well target (not shown) on which the jack-up rig 100 is carrying out its operations. Jack-up rigs are considered to be well known to the person skilled in the art and are therefore not discussed in more detail here. This disclosure has impact on the cantilever platform 130 only. In the description hereinafter, only the cantilever platform 130 and the objects to be placed on it are further discussed. The way the cantilever platform 130 is mounted to the buoyant hull 120 may be the same as in the prior art.

Figure 2:
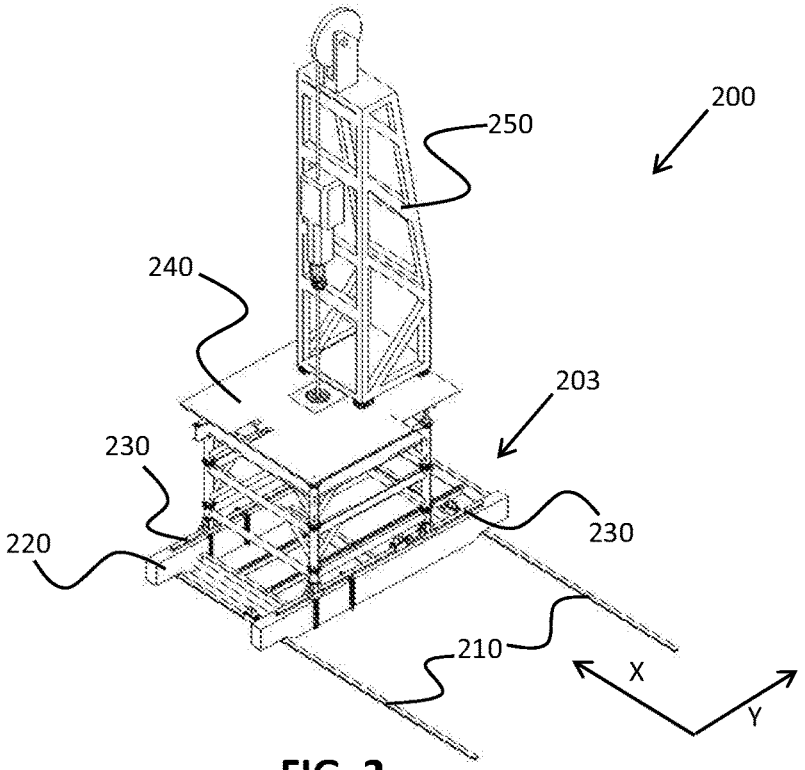
FIG. 2 shows a movable derrick assembly in accordance with an aspect of this disclosure.

FIG. 2 shows a movable derrick assembly 200 in accordance with an aspect of this disclosure. The movable derrick assembly 200 comprises a conventional skid system 203 onto which a derrick 250 is placed. The skid system 203 comprises a pair of X-direction rails 210, which may be placed on the cantilever platform 130 of FIG. 1, for example. Onto the X-direction rails 210 there is mounted Y-direction support frame (in the form of two interconnected beams) 220, which may be slid along the X-direction rails 210, as illustrated. On the Y-direction support frame 220 there is provided a pair of Y-direction rails 230. On the Y-direction rails 230 there is provided a main support structure 240. The main support structure 240 may be slid along the Y-direction rails 230. The derrick 250 is mounted on the support structure 240. The derrick 250 and main support structure 240 in accordance with this disclosure are preferably made as compact as possible in terms of areal consumption (in X-Y direction), which will be further explained with reference to other FIGS. 7 and 13. What is defined as X-direction and Y-direction has been illustrated in FIG. 2 and many of the other figures. This disclosure is explicitly not limited to such definition. Other definitions are also possible.

FIG. 2 shows a single movable derrick 200. This disclosure relates to providing at least two derricks on a single cantilever platform in such a way that the derricks are independently movable (in at least two dimensions within a plane parallel to the cantilever platform) while still being compact in area usage. This requirement may lead to a design challenge.

Figure 3:
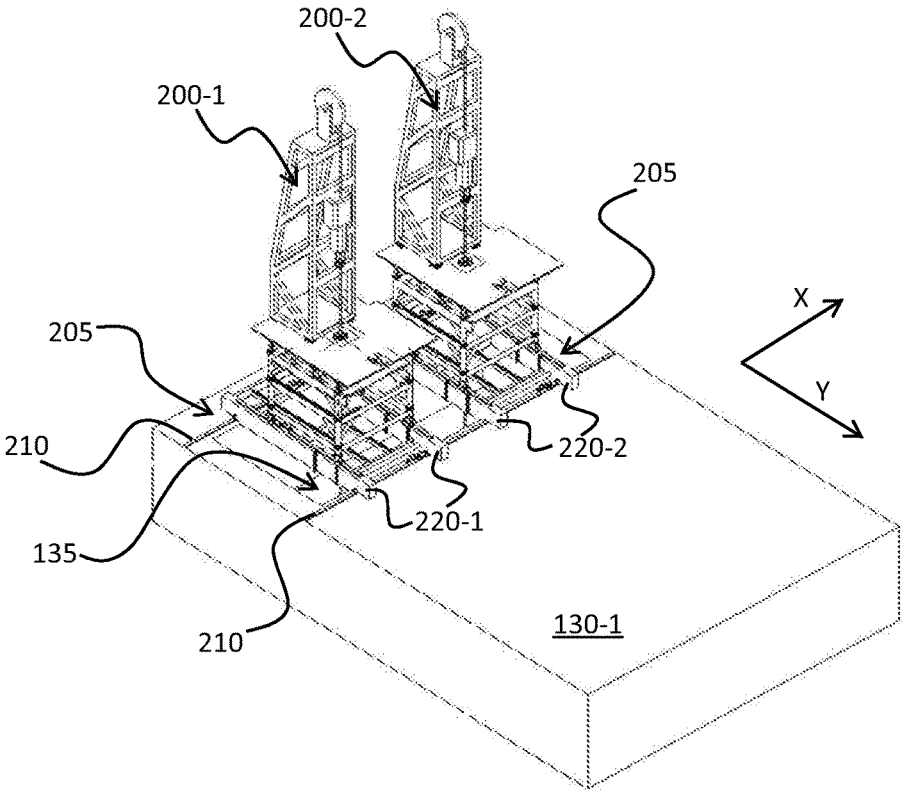
FIG. 3 shows a first embodiment of a movable dual derrick assembly in accordance with this disclosure.
Figure 4:
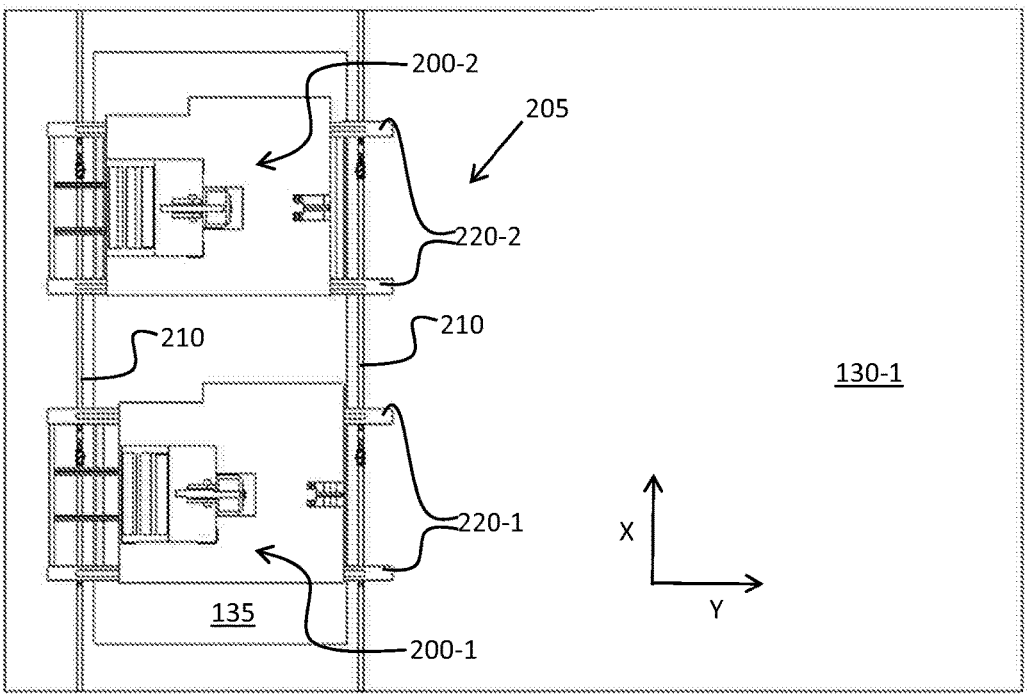
FIG. 4 shows a top view of the embodiment of FIG. 3.

FIG. 3 shows a first embodiment of a movable dual derrick assembly 200-1, 200-2 which allows for a compact provision of two movable derrick assemblies 200-1, 200-2 on a single cantilever platform 130-1. FIG. 3 shows a first embodiment of a cantilever platform 130-1. FIG. 4 shows a top view of the embodiment of FIG. 3. FIG. 3 shows that the cantilever platform 130-1 is provided with an opening 135 above which a skid system 205 in accordance with a first embodiment is placed. The skid system 205 comprises a pair of X-direction rails 210 similar to FIG. 2, one respective rail 210 on each side of the opening 135, as illustrated. Furthermore, there is provided a first support frame 220-1 and a second support frame 220-2, each being similar to the one of FIG. 2. Both support frames 220-1, 220-2 are provided on the same pair of X-direction rails 210. The respective movable derrick assemblies 200-1, 200-2 that are provided on each support frame 220-1, 220-2 are the same as in FIG. 2. FIG. 4 illustrates clearly how compact the solution of FIG. 3 is in terms of areal consumption. The two movable derrick assemblies 200-1, 200-2 together cover the whole area of the opening 135.

Figure 5:
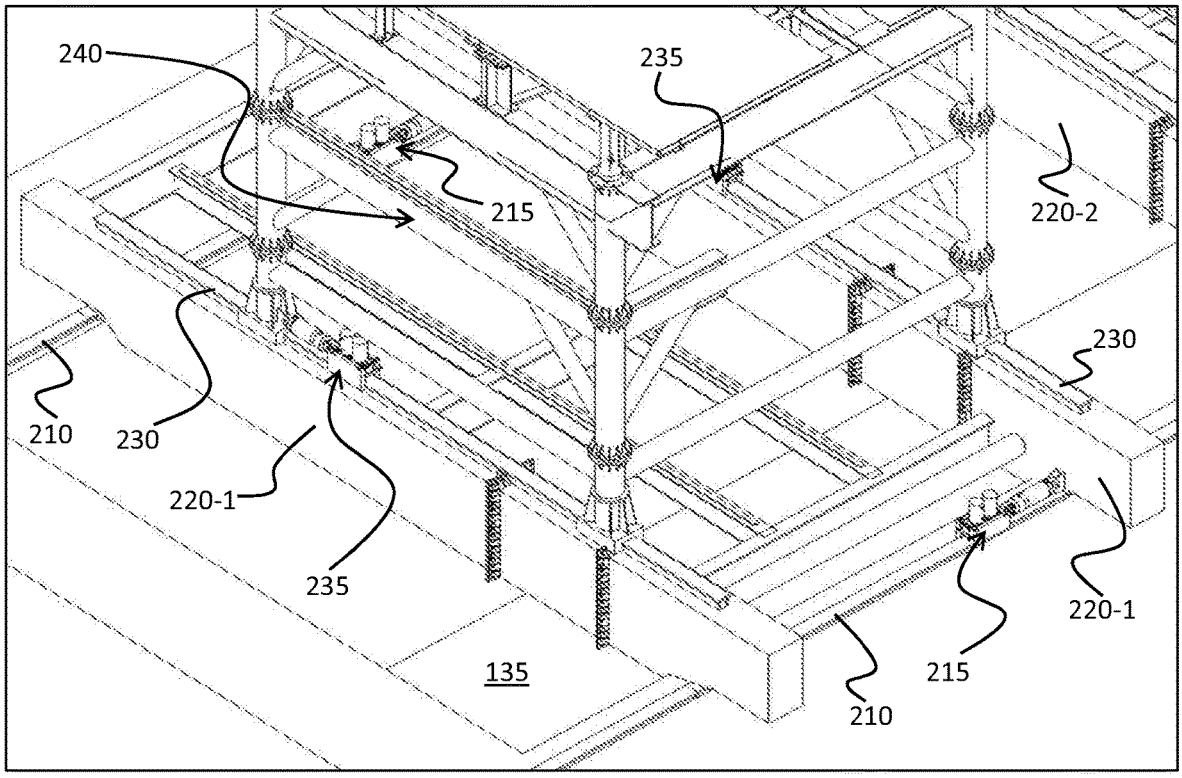
FIG. 5 shows an enlarged view of part of FIG. 3 illustrating the skidding system used in the embodiment of FIG. 3.
Figure 6:
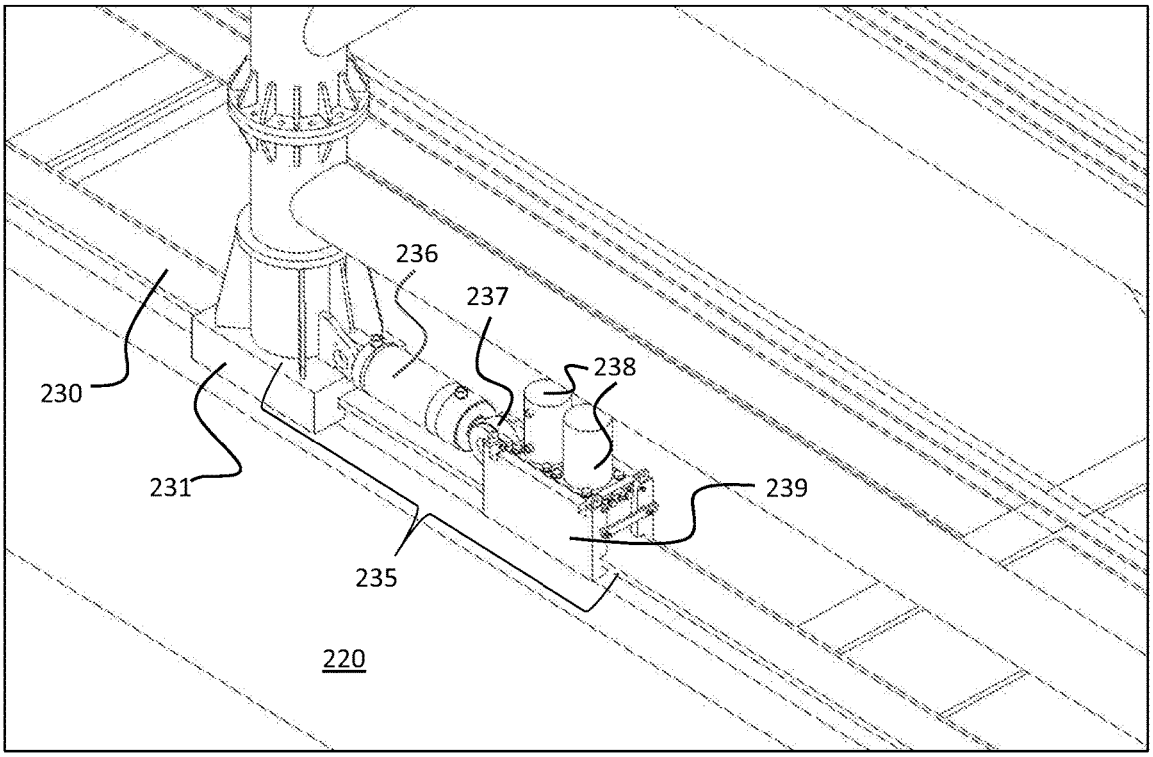
FIG. 6 shows an enlarged view of part of FIG. 5.

FIG. 5 shows an enlarged view of part of FIG. 3 illustrating the skidding system used in the embodiment of FIG. 3. In this figure the manipulators for moving the respective parts are visible more clearly. First of all, there is shown a pair of X-manipulators 215 (X-skid manipulator) on the X-direction rails 210. Second, there is shown a pair of Y-manipulator 235 (Y-skid manipulator) on the Y-direction rails 230. The manipulators 215, 235 are configured for moving the support frames 220-1, 220-2 and the support structure 240 along the respective rails 210, 230. FIG. 6 shows an enlarged view of one manipulator 235 illustrated in FIG. 5. The manipulator 235 comprises a skidding cylinder 236 on one end. The skidding cylinder 236 is connected to the respective part 231, here a foot of the derrick support structure 240. The skidding cylinder 236 pulls or pushes part 231 along the rail 230. The foot 231 is slideably mounted on the rail 230. On an opposite end of the (extendable and contractible) skidding cylinder 236, there is a pivot 237, which is subsequently connected to a clamp 239. The clamp 239 is activated by clamping cylinder 238. The manipulator 235 will clamp on the rail 230 and drag the entire structure 240, 250 above it. After that, it will disengage from the rail 230, extend and clamp again to the rail 230. The sequence is repeated until the target position is reached. The resulting movement is similar to a how a worm moves. Manipulators 235 of this kind and their way of operation are considered well known in the offshore sector as such, i.e. they constitute known technology, and are therefore not discussed in more detail in this specification.

Figure 7:
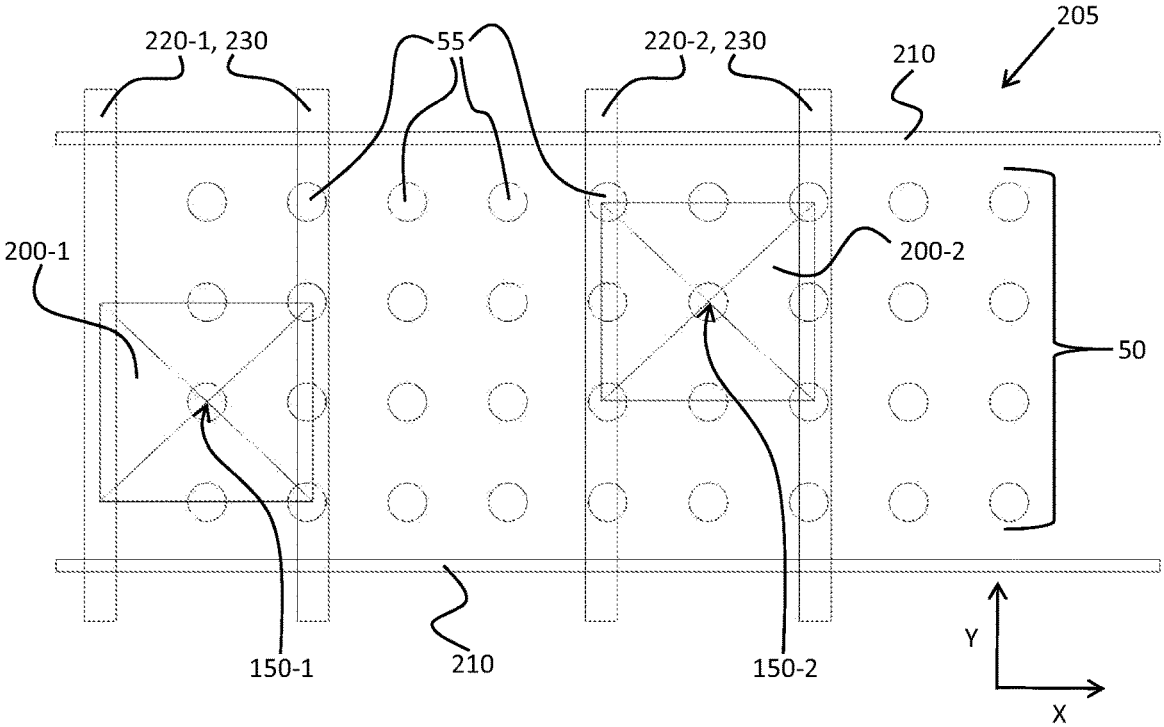
FIG. 7 shows a schematic plan view of the embodiment of FIG. 3 when provided above a well pattern.

FIG. 7 shows a schematic plan view of the embodiment of FIG. 3 when provided above a well pattern. This figure mainly serves to illustrate how the movable dual derrick assembly 200 in accordance with this disclosure relates to the well pattern 50 onto which it is to be used. The well pattern 50 comprises a plurality of well targets 55 arranged in an array as illustrated. The first movable derrick assembly 200-1 has been schematically illustrated with a respective square in the figure, including its operational centerline 150-1 (first operational centerline) at a centre of the square. The second movable derrick assembly 200-2 has also been schematically illustrated with a respective square in the figure, including its operational centerline 150-2 (second operational centerline) at a centre of the respective square. It can be seen from FIG. 7 that the two movable derrick assemblies 200-1, 200-2 together cover the whole well pattern 50, i.e. all well targets 55 can be reached. It can be also seen in FIG. 7 that the more compact the derrick assemblies 200-1, 200-2 are (smaller squares) the better the well target reachability.

FIG. 8 shows a second embodiment of a movable dual derrick assembly 200-1, 200-2. This figure shows a second embodiment of a cantilever platform 130-2. The respective movable derrick assemblies 200-1, 200-2 in this embodiment are provided on a different skid system 305.

FIGS. 9*a*-9*b* show a top view of the embodiment of FIG. 8. Each of FIGS. 9*a*, 9*b* illustrate the respective derricks 200-1, 200-2 in different positions. These figures illustrate that each respective derrick assembly 200-1 can be moved along respective XY-rails 315, which are provided in an array as illustrated. This array defines four sectors S1, S2, S3, S4 as illustrated. In FIG. 9*a* the first movable derrick assembly 200-1 is located in the second sector S2 and the second movable derrick assembly 200-2 is located in the third sector S3. In order to arrive at the positions as illustrated in FIG. 9*b*, the second movable derrick assembly 200-2 is moved to the first sector S1 and the first movable derrick assembly 200-1 is moved to the third sector S3 in accordance with the arrows M1, M2 in FIG. 9*a*. It is explicitly mentioned that the respective movable derrick assemblies 200-1, 200-2 may also be located at various intermediate positions in between the first sector S1 and the second sector S2, in between the second sector S2 and the fourth sector S4, in between the third sector S3 and the fourth sector S4, and in between the first sector S1 and the fourth sector S4. This is also illustrated in FIG. 13.

FIG. 10 shows part of the skidding system 305 used in the embodiment of FIG. 8. In this figure, the earlier-mentioned XY-rails 315 are more clearly illustrated. The figure also shows that the XY-rails 315 are also provided on beams 137 that cross the opening in the cantilever 130-2 effectively defining four openings 135-2 (one per sector) as illustrated. In order to facilitate transportation from one sector to the other the XY-rails 315 are provided with cuts 316 (or interruptions) at corners and crossing of the XY-rails.

FIG. 11 shows another part of the skidding system 305 used in the embodiment of FIG. 8. This part comprises an XY support frame 325 as illustrated. The support frame 325 comprises skid beams in both the X-direction and Y-direction, which are slideably mounted on the XY-rails 315. The support frame 325 is provided with X-manipulators 326 (X-skid manipulators) and Y manipulators 327 (Y-skid manipulators) as illustrated. Different alternatives are possible for making the support frame 325 slideable with regards to the XY-rails 315 (i.e. also referred to as the guiding function).

In another embodiment, the manipulators 326, 327 perform said guiding function, i.e. the manipulators keep the support frame (skidding base) 325 in place. Such solution is feasible, because the jack-up rig is not subject to waves during drilling operations (i.e. it has lifted itself out of the water by extending the movable legs towards the sea floor). When the jack-up rig is towed, the skid base may be fixed in position using specialised parking bolts through the holes 330 in the corners of the XY-support frame 325 shown in the FIG. 11.

In another embodiment, a special guide element is used (not visible in drawings). This guiding element is mounted on the each corner of the skid base 325 and can be shaped for engaging with the XY-rails 315 in both X- and Y direction. The shape (at a bottom side thereof) looks like an inverse-cross, wherein each arm of the inverse-cross looks similar to foot 231. With reference to FIG. 10, it is submitted that the respective legs of this cross should not exceed beyond the gap of the interruptions 316 at the crossings and corners; otherwise it is not able to cross interruptions at said crossings and corners. Two-direction guiding systems like these as such are considered known in the offshore industry.

In the embodiment of FIG. 11, on top of the support frame 325, there is provided a further X-direction rails 328 similar to the Y-direction rails. On the further X-direction rails 328, there is visible a further X-manipulators 329 (further X-skid manipulators).

The manipulators 326, 327 are slightly amended in order to facilitate the movement in both X-direction and Y-direction. This will be explained further with reference to FIG. 12, which shows an enlarged view of part of the skidding system 305 illustrated in FIG. 11, when the derrick support structure 240 is provided on top of it. In FIG. 12, the X-manipulator 326 is disengaged from the respective rail by being lifted up in accordance with the arrow. Such disengagement (which functionality both the X-manipulator 326 as well as the Y-manipulator 327 have) is necessary to allow the respective XY support frame 325 to be moved to another sector in a direction orthogonal to the respective rail, from which the manipulator is disengaged.

FIG. 13 shows a schematic plan view of the embodiment of FIG. 8 when provided above a well pattern. The figure illustrates, similar to FIG. 7, the well pattern 50 comprising the well targets 55. Further, FIG. 13 illustrates a first XY-support frame 325-1 and a second XY-support frame 325-2. In this particular figure, both the first XY support frame 325-1 as well as the second XY-support frame 325-2 are located in intermediate positions as already mentioned with reference to FIG. 9. In these positions, the frames 325-1, 325-2 cannot be moved in the X-direction. Therefore, in this embodiment, there is a need for the further X-direction rails 328 as illustrated in FIGS. 11 and 12, such that all well targets 55 can be reached. There are also embodiments where these further X-direction rails 328 are not needed, and there are embodiments where even further Y-direction rails may be required. This depends on the dimensions of the respective platforms, the dimensions of the support frames (skidding base dimensions), the number of sectors, and the number of movable derrick assemblies.

The disclosure provides, compared to existing technologies, a Mobile Offshore Drilling Unit (MODU) that can have several drilling units for operating on different offshore wells simultaneously. The operations carried out on a specific well target do not depend on the position of the other drilling units. Furthermore, two or more drilling units are operating on a single cantilever, with great benefits in regards to flexibility. It is possible to use various X-Y skidding systems of which two examples have been discussed. Another benefit relates to the fact that with at least some embodiments disclosed herein, more space is available on the cantilever for other drilling equipment like drill pipe storage, mud system and hydraulic units. Instead of requiring two separate cantilevers as in one of the prior art solutions, embodiments disclosed herein have only one cantilever, on which two or more mobile derricks can move independently. This characteristic results in benefits for flexibility (different types of skidding systems can be used) and for the space available on cantilever. The ability of having multiple independent drilling units on a single cantilever is possible due to at least a subset of the following features:

1) Two or (more) compact drilling towers, which are able to skid forward/backward or left/right.
2) The use of one (large) cantilever platform, able to skid in/out or left/right. The cantilever platform has a large opening over which two or more drilling towers (derricks) are located. The drilling towers can operate independently on two (or more for some embodiments) well targets. In addition, the towers can skid independently on different targets and they can do different operations: e.g. drilling and completion.
3) Specialised X-Y skidding systems. Skidding as such is a proven technology widely used in the offshore industry to skid heavy structures on X-Y directions.

Many variations on the embodiments described herein and shown in the figures are possible. For instance, the number of movable derrick assemblies may be higher than two, and the number of sectors in the second embodiment may be higher than four. It is also possible to make said derrick assemblies rotatable with regards to the cantilever platform by implementing heave duty bearings as known from the crane industry. Such bearing could be implemented between the respective derrick support structure and the skid system, for example. This extra degree of freedom may make it easier to cover all well targets with the well pattern, i.e. reduces the blind zones in certain relative positions of the derrick assemblies.

The particular embodiments disclosed above are illustrative only, and may be modified and practiced in different but equivalent manners apparent to those skilled in the art having the benefit of the teachings herein. For example, the method steps set forth herein may be performed in a different order. Furthermore, no limitations are intended to the details of construction or design herein shown, other than as described in the claims below. Accordingly, the protection sought herein is as set forth in the claims below.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. Jack-up rig comprising:

a cantilever platform mounted on a buoyant hull;

at least two drilling assemblies disposed on the cantilever platform, wherein each of the drilling assemblies is movable relative to the cantilever platform and movable independently from the other drilling assembly or assemblies, respectively;

wherein each of the drilling assemblies is movable within a plane parallel to the cantilever platform in both X-direction (X) as well as Y-direction (Y) orthogonal to the X-direction (X);

wherein the drilling assemblies are provided on a skid system, wherein the skid system is provided on the cantilever platform, and wherein the skid system comprises:

XY-rails provided on the cantilever platform, wherein the XY-rails are arranged to form an array of rails;

at least two XY-support frames mounted on the XY-rails such that the XY-support frames can slide both directions in accordance with the respective directions of the XY-rails; and one respective drilling support structure on each one of the XY-support frames.

2. The jack-up rig in accordance with claim 1, wherein at least one further skid system is provided between each respective drilling support structure and respective XY-support frame configured to enable at least one extra translation degree-of-freedom.

3. The jack-up rig in accordance with claim 1, further comprising respective skid-manipulators mounted for skidding.

4. The jack-up rig in accordance with claim 1, wherein each drilling assembly comprises a drilling unit placed on the drilling support structure.

* * * * *